US010589548B2

(12) United States Patent
Ishihara et al.

(10) Patent No.: US 10,589,548 B2
(45) Date of Patent: Mar. 17, 2020

(54) PRINTING APPARATUS

(71) Applicant: SEIKO EPSON CORPORATION, Tokyo (JP)

(72) Inventors: Masakazu Ishihara, Matsumoto (JP); Kazuhiro Nishiyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/230,693

(22) Filed: Dec. 21, 2018

(65) Prior Publication Data

US 2019/0193431 A1 Jun. 27, 2019

(30) Foreign Application Priority Data

Dec. 26, 2017 (JP) ..... 2017-248843

(51) Int. Cl.

| | |
|---|---|
| ***B41J 13/00*** | (2006.01) |
| ***B65H 5/38*** | (2006.01) |
| ***B65H 5/06*** | (2006.01) |
| ***B41J 11/00*** | (2006.01) |
| ***B41J 13/10*** | (2006.01) |

(52) U.S. Cl.

CPC ..... *B41J 13/0018* (2013.01); *B41J 11/0045* (2013.01); *B41J 13/103* (2013.01); *B65H 5/062* (2013.01); *B65H 5/38* (2013.01)

(58) Field of Classification Search

CPC .. B41J 11/0045; B41J 13/103; B41J 13/0018; B65H 5/062; B65H 5/38

See application file for complete search history.

(56) References Cited

U.S. PATENT DOCUMENTS

| | | | | |
|---|---|---|---|---|
| 6,490,843 | B1 * | 12/2002 | May | B65B 43/185 271/108 |
| 8,087,657 | B2 * | 1/2012 | Hamada | B65H 5/062 271/3.01 |
| 2003/0155706 | A1 * | 8/2003 | Tsutoh | B65H 5/062 271/272 |

FOREIGN PATENT DOCUMENTS

| | | |
|---|---|---|
| JP | 01-164242 | 11/1989 |

* cited by examiner

*Primary Examiner* — Lamson D Nguyen
(74) *Attorney, Agent, or Firm* — Workman Nydegger

(57) ABSTRACT

A printing apparatus includes a printing unit that performs printing on a medium, an apparatus main body that houses the printing unit therein and that has outer surfaces including an upper surface and a front surface that adjoiningly intersects the upper surface, a paper feed port that is provided on the upper surface of the apparatus main body and that enables the medium to be fed into the apparatus main body, a feed path that is guiding the medium fed from the paper feed port toward the printing unit and that has a curved portion for inverting the medium during the guiding, a pair of rollers that are provided at the upstream of the curved portion and that feed the medium toward the printing unit via the feed path by rotating while nipping the medium fed from the paper feed port from both front and rear sides.

6 Claims, 4 Drawing Sheets

PRINTING APPARATUS

BACKGROUND

1. Technical Field

The present invention relates to a printing apparatus that performs printing on a medium.

2. Related Art

To date, printing apparatuses such as printers that include a printing unit that performs printing by ejecting a liquid such as ink onto a medium such as a paper sheet are known. Among such printing apparatuses, in addition to automatically feeding a paper sheet from a paper feed cassette housing a plurality of paper sheets in a stacked state, there is a printing apparatus in which a manual feeder is provided on the upper surface of the apparatus so that the user can feed paper sheets by manually feeding the paper sheets from the front side of the apparatus one by one to the printing unit (for example, JP-UM-A-1-164242).

In such a printing apparatus, the manual feeder includes a manual insertion port for enabling a paper sheet to be fed manually from the front side of the apparatus, a transfer guide portion that communicates with the manual insertion port and curves downward inside the apparatus and a pair of rollers that supply the paper sheet to the printing unit by nipping the paper sheet, which has been inverted through the transfer guide portion, from both the front and rear sides.

When the paper sheet is manually fed through the manual feeder to the printing unit, the paper sheet is manually fed into the manual insertion port from the front side of the apparatus and the paper sheet is fed from the front side to the rear side of the upper surface of the apparatus. Then, the fed paper sheet is inverted by the transfer guide portion inside the apparatus, reaches a pair of rollers, which are positioned further downstream in the paper feed direction than the transfer guide portion, in a curved state, and is fed to the printing unit through rotation of the pair of rollers.

In the above-described existing printing apparatus, the paper sheet fed to the manual feeder is fed to the pair of rollers in a curved state as a result of passing through the transfer guide portion, which is curved. Therefore, when the end portion of the fed paper sheet abuts against the pair of rollers, there is a problem that the paper sheet in such a curved state has low stiffness and is easily bent.

SUMMARY

An advantage of some aspects of the invention is that a printing apparatus capable of suppressing bending of a fed medium in the case where the medium is fed through a curved path toward a printing unit in the apparatus main body is provided.

An aspect of the invention and advantages thereof will be described below.

A printing apparatus according to an aspect of the invention includes a printing unit that performs printing on a medium, an apparatus main body that houses the printing unit therein and that has outer surfaces including an upper surface and a front surface that adjoiningly intersects the upper surface, a paper feed port that is provided on the upper surface of the apparatus main body and that enables the medium to be fed into the apparatus main body, a feed path that is capable of guiding the medium fed from the paper feed port toward the printing unit and that has a curved portion for inverting the medium during the guiding, a pair of rollers that are provided at the upstream of the curved portion in the feed path and that feed the medium toward the printing unit via the feed path by rotating while nipping the medium fed from the paper feed port from both front and rear sides.

According to this configuration, the medium fed from the paper feed port into the apparatus main body and guided toward the printing unit via the feed path abuts against the pair of rollers before its end reaches the curved portion in the feed path. Then, from this state, the pair of rollers rotate while nipping the medium from the front and rear sides so that the fed medium is fed to the printing unit along the curved portion. That is, although the fed medium curves as it passes through the curved portion of the feed path, before the medium curves, the medium abuts against the pair of feeding rollers and does not become curved. Therefore, it is possible to suppress bending in the case where the fed medium is fed through the curved path toward the printing unit in the apparatus main body.

In the printing apparatus, it is preferable that the paper feed port open toward a front side of the apparatus main body and a medium placement surface on which the medium can be placed be provided on the upper surface of the apparatus main body so as to extend along a paper feed direction from the front side toward the paper feed port.

As a result, the user can place the medium for paper feeding on the medium placement surface provided on the upper surface of the apparatus main body from the front side of the apparatus main body, and, by sliding the medium placed in such a manner rearward along the medium placement surface from the front side, the medium can be easily fed from the paper feed port into the feed path.

In the printing apparatus, it is preferable that the apparatus main body include a housing having an opening portion on an upper surface of the housing and a lid attached to the housing so as to close the opening portion, the medium placement surface be provided on the upper surface of the lid, the lid include a first lid disposed on a downstream side in the paper feed direction and a second lid disposed on an upstream side in the paper feed direction, one of the first lid and the second lid be fixed to the housing, and the other be attached to the housing so as to be displaceable between an open position in which the opening portion is open and a closed position in which the opening portion is closed.

According to this configuration, even if the medium placement surface is provided on the upper surface of the lid, by displacing one of the first lid and the second lid among the lids to the open position, it is possible to make the inside of the housing visible.

In the printing apparatus, it is preferable that the medium placement surface include an inclined surface which is inclined so as to descend from the upstream side to the downstream side in the paper feed direction.

According to this configuration, by utilizing the inclination of the inclined surface of the medium placement surface, it is easy to feed the medium placed on the medium placement surface to the paper feed port. In addition, on the upper surface of the apparatus main body, the height of the portion provided with the inclined surface can be lower than the height of the portion without the inclined surface.

In the printing apparatus, it is preferable that the medium placement surface have a first placement surface disposed on the upper surface of the first lid and a second placement surface disposed on the upper surface of the second lid, the first placement surface be inclined so as to descend from the upstream side to the downstream side in the paper feed direction, the second placement surface include an upstream-side horizontal surface positioned on the upstream side in the paper feed direction and a downstream-side inclined surface that is inclined so as to descend from the upstream side to the downstream side in the paper feed direction on the downstream side of the upstream-side horizontal surface in the paper feed direction, and the inclined surface be formed so that the downstream-side inclined surface of the second placement surface and the first placement surface are continuous in the paper feed direction.

As a result, for example, compared with the case where an inclined surface is provided only in the first lid, the area of the inclined surface in the medium placement surface is increased. Therefore, it becomes easier to feed the medium placed on the medium placement surface toward the paper feed port.

In the printing apparatus, it is preferable that, on the first placement surface, edge guides that enable positioning of the medium placed on the medium placement surface in the width direction be provided.

According to this configuration, it is possible to suppress skewing with respect to the paper feed direction from occurring on the medium placed on the medium placement surface by the edge guides.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a printing apparatus will be described with reference to the drawings.

Figure 1:
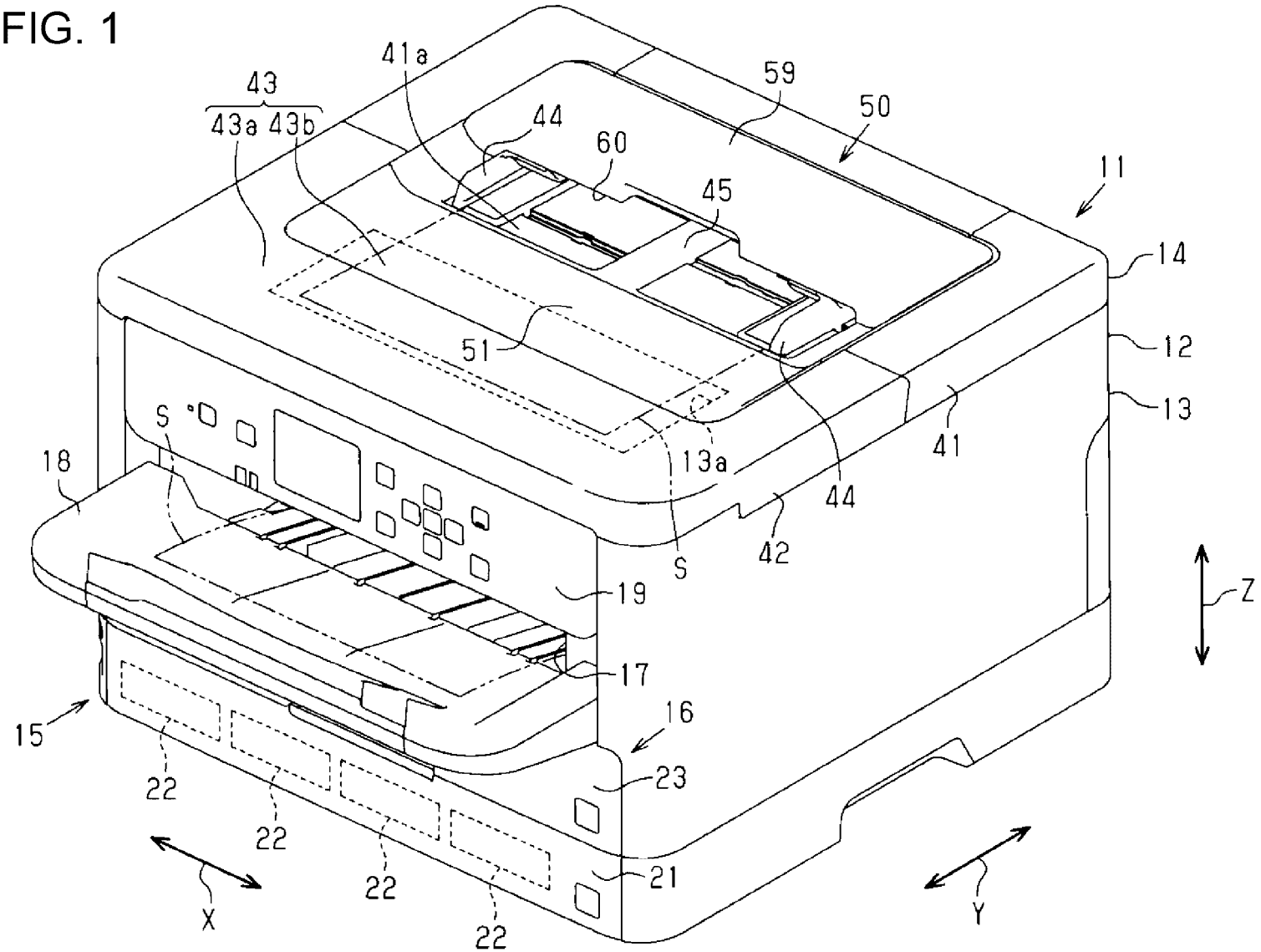
FIG. 1 is a perspective view illustrating a printing apparatus according to one embodiment.

As illustrated in FIG. 1, a printing apparatus 11 of the present embodiment is an ink jet type printer that prints by ejecting ink, which is an example of a liquid, onto a medium S such as a paper sheet.

The printing apparatus 11 includes an apparatus main body 12 having predetermined lengths as a height, a depth, and a width, respectively, in a state of being installed in a place of usage. In the present embodiment, the width direction and the depth direction are substantially horizontal, and the direction of gravity is indicated by the Z axis assuming that the printing apparatus 11 is placed on a horizontal surface. The depth direction is indicated by the Y axis. The width direction is indicated by the X axis, which intersects the Z axis and the Y axis. The X axis, the Z axis, and the Y axis are coordinate axes indicating the lengths of the width, the height, and the depth, respectively. The width direction, the height direction and the depth direction are directions different from each other.

The apparatus main body 12 has outer surfaces including an upper surface and a front surface that adjoiningly intersects the upper surface. The apparatus main body 12 includes a housing 13 having an opening portion 13*a* on its upper surface and a lid 14 attached to the housing 13 so as to close the opening portion 13*a*. In the apparatus main body 12, a mounting unit 15 and a first medium setting unit 16 are disposed in order from the bottom side, which is the lower side in the height direction, to the upper side. In addition, a discharge port 17 through which the medium S that has been printed on is discharged, a discharge tray 18 that extends forward so that the medium S discharged from the discharge port 17 can be placed thereon, and an operation unit 19 that is used to operate the printing apparatus 11 are arranged on the front surface of the apparatus main body 12 and on the upper side of the first medium setting unit 16. Further, note that the front surface of the apparatus main body 12 refers to a side surface having a height and a width and is a side surface through which operations are mainly performed on the printing apparatus 11.

The mounting unit 15 is covered with a rotatable front lid 21 that constitutes a portion of the front surface of the apparatus main body 12. One or a plurality (four in this embodiment) of containers 22 can be mounted in the mounting unit 15. In each of the containers 22, a liquid housing unit (not illustrated) for storing the liquid used by the printing apparatus 11 for printing on the medium S is detachably mounted. The liquid housing units house liquids of different types (for example, inks of different colors such as black, cyan, magenta, and yellow). In addition, the containers 22 are detachably attached to the mounting unit 15 even in a state where the containers 22 do not hold the liquid housing units. Further, the mounting unit 15 may be configured to enable direct attachment of the containers 22.

Figure 2:
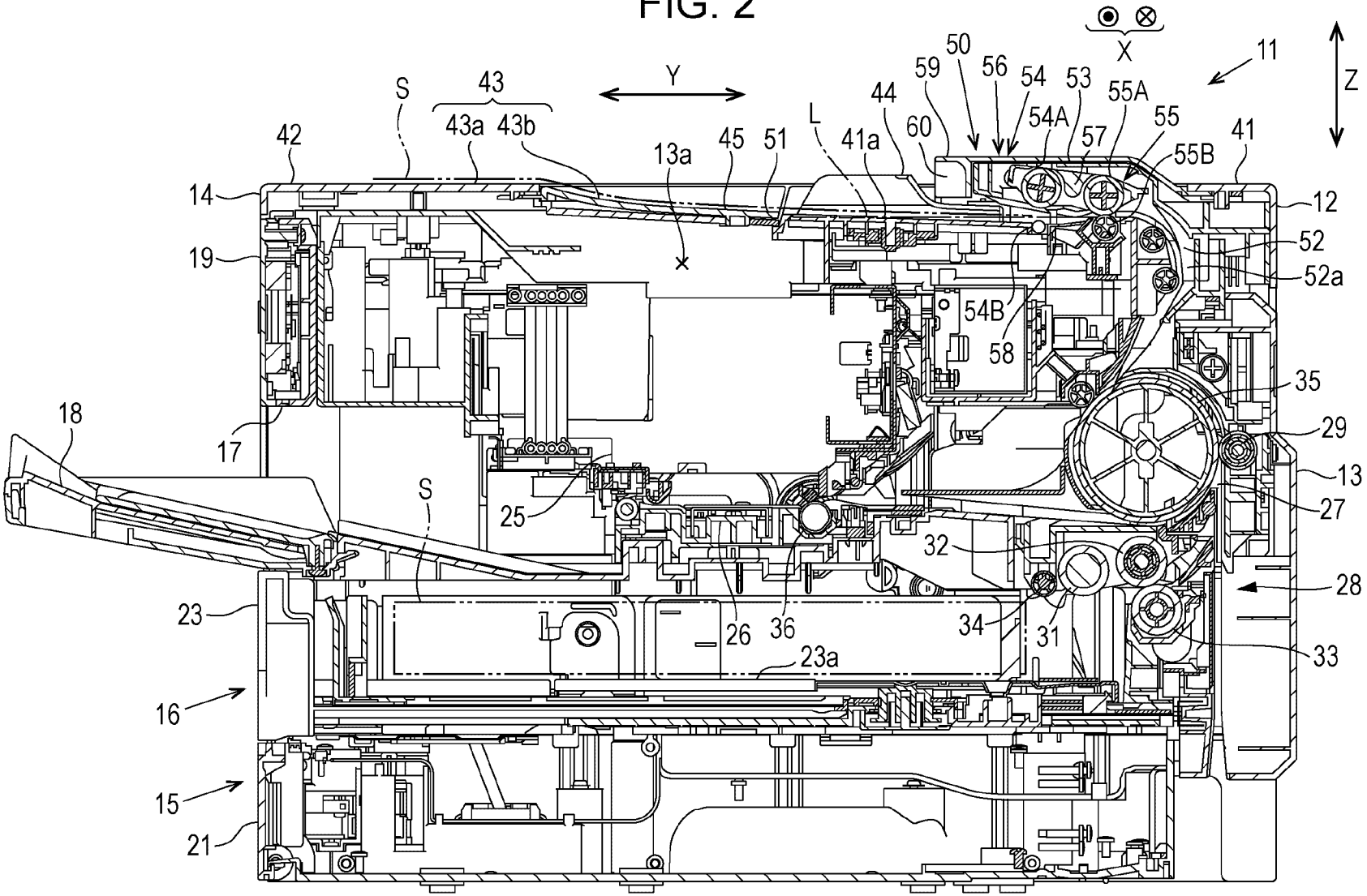
FIG. 2 is a side cross-sectional view schematically illustrating an internal structure of the printing apparatus.

As illustrated in FIG. 2, in the first medium setting unit 16, a medium housing body 23 capable of housing the medium S is detachable. That is, the medium housing body 23 is attachable to and detachable from the apparatus main body 12. The medium housing body 23 has a bottomed box shape with an open upper surface, and the media S before being printed on by the printing apparatus 11 are placed on an inner bottom surface 23*a* in a stacked state. The front surface of the medium housing body 23 constitutes a portion of the front surface of the apparatus main body 12 when the medium housing body 23 is attached to the apparatus main body 12.

The apparatus main body 12 houses a printing unit 25 and a medium supporting unit 26 at a position on the upper side of the first medium setting unit 16. The printing unit 25 is connected by flow paths to the containers 22 mounted in the mounting unit 15 and performs printing on the medium S by using (ejecting) the liquid supplied from the containers 22. The medium supporting unit 26 is arranged so as to face the printing unit 25 in the vertical direction and supports the medium S (on which printing is performed by the printing unit 25) from below.

In addition, the apparatus main body 12 has a first transport path 27 that extends from the first medium setting unit 16 toward the printing unit 25 and a first feeding unit 28 for feeding the medium S housed in the medium housing body 23 mounted in the first medium setting unit 16 to the first transport path 27 and a first transport unit 29 that transports the medium S fed by the first feeding unit 28 along the first transport path 27. After extending from the rear side to the upper side of the first medium setting unit 16, the first transport path 27 curves toward the front of the printing apparatus 11 in order to invert the medium S and extends to a position between the printing unit 25 and the medium supporting unit 26.

The first feeding unit 28 includes a pickup roller 31 that extracts the medium S from the medium housing body 23 by rotating while being in contact with the surface of the medium S housed in the medium housing body 23 mounted in the first medium setting unit 16. In addition, the first feeding unit 28 includes a separating roller 32 and a retard roller 33 that transport the medium S toward the first transport path 27 by rotating in a state where the medium S extracted from the medium housing body 23 by the rotation of the pickup roller 31 is nipped from both the front and rear sides by the separating roller 32 and the retard roller 33.

The pickup roller 31 is disposed above an end portion in the depth direction, which serves as a rear side of the medium housing body 23, which is mounted in the first medium setting unit 16. The pickup roller 31 rotates in a forward rotation direction, which is a counterclockwise direction in FIG. 2, thereby extracting the medium S from the medium housing body 23. The separating roller 32 and the retard roller 33 are disposed on the far side in the depth direction with respect to the pickup roller 31 and are opposed to each other so as to nip the medium S from both the front and rear sides. The retard roller 33 is positioned below the separating roller 32.

Further, the retard roller 33 is a roller which is driven to rotate with the rotation of the separating roller 32. In addition, the retard roller 33 is configured so that the friction coefficient with respect to the medium S is larger than that of the separating roller 32. Then, in the case where a plurality of sheets of the media S in a stacked state are fed from the medium housing body 23, the separating roller 32 and the retard roller 33, due to the difference in friction coefficient, separate the media S one by one and transport the media S. A pressing roller 34 is disposed on the side opposite to the side where the separating roller 32 and the retard roller 33 are positioned with respect to the pickup roller 31, that is, in front of the pickup roller 31 in the depth direction.

The first transport unit 29 has a plurality of rollers arranged along the first transport path 27. In the present embodiment, a feed roller 35 and a transport roller 36 are arranged in order from the upstream side in the first transport path 27. Further, it should be noted that the first transport unit 29 may be configured to have rollers other than the feed roller 35 and the transport roller 36. In the case of the present embodiment, the feed roller 35 is disposed directly above the separating roller 32. The feed roller 35 transports the medium S fed by the first feeding unit 28 while curving the medium S along the first transport path 27 from the top to the front. Further, it should be noted that the feed roller 35 may transport the medium S fed by the user's manual feeding from a second medium setting unit 50 arranged on the upper surface of the apparatus main body 12 in the middle of the first transport path 27 and transport it forward. The transport roller 36 is provided at a position closer to the downstream side in the first transport path 27 and is disposed adjacent to the medium supporting unit 26. The transport roller 36 transports the medium S transported by the feed roller 35 forward along the first transport path 27.

The first transport unit 29 transports the medium S extracted by the pickup roller 31 from the medium housing body 23 onto the medium supporting unit 26 arranged on the downstream side in the first transport path 27. At this time, after the medium S has been extracted from the medium housing body 23 to the rear side, because it is transported to the front side while being curved toward the medium supporting unit 26, the posture of the medium S is inverted vertically from when the medium S is located inside the medium housing body 23 to when it is positioned on the medium supporting unit 26. In addition, the width direction of the medium S being transported is a direction coincident with the width direction of the printing apparatus 11. The medium S on which the printing by the printing unit 25 has been completed is discharged onto the discharge tray 18 from the discharge port 17 located in front of the printing unit 25 in the apparatus main body 12.

Figure 3:
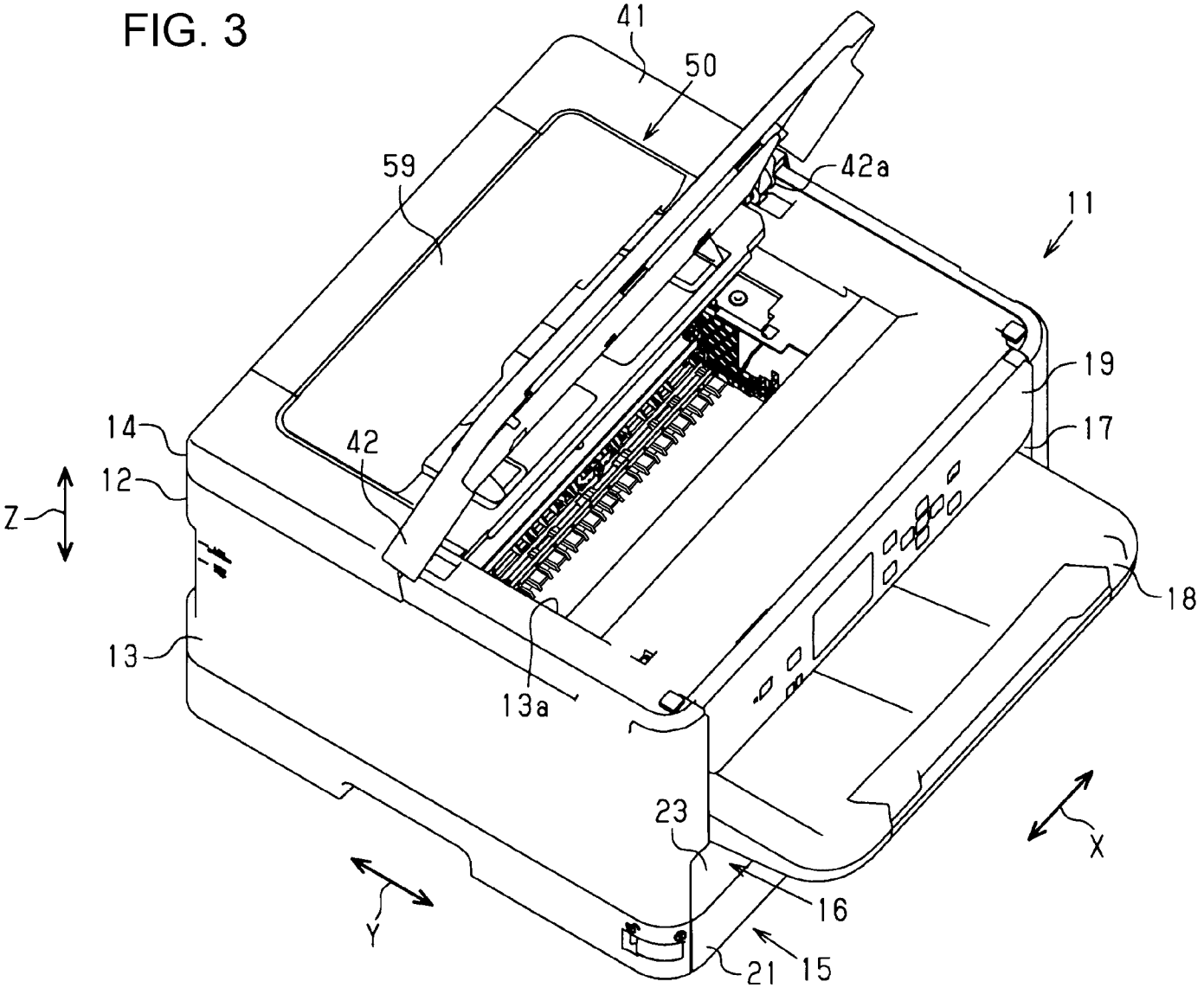
FIG. 3 is a perspective view illustrating the printing apparatus in which a second lid is in an open state.

As illustrated in FIG. 3, on the upper surface of the housing 13, a first lid 41 positioned on the rear side of the apparatus main body 12 is fixed to the housing 13. In addition, the opening portion 13*a*, which is rectangular, is formed in the upper surface of the housing 13 at the front side of the apparatus main body 12 and a second lid 42 is provided so as to cover the opening portion 13*a*. The second lid 42 is attached to the housing 13 by a hinge 42*a* so as to be rotatable. The second lid 42 is attached to the housing 13 so as to be displaceable between an open position in which the opening portion 13*a* is open and a closed position in which the opening portion 13*a* is closed. That is, in the open position, the medium supporting unit 26 in the apparatus main body 12 can be viewed from the opening portion 13*a*.

As illustrated in FIG. 1 and FIG. 2, the apparatus main body 12 includes the second medium setting unit 50 disposed on the upper surface of the apparatus main body 12 and a second transport path 52 extending from the second medium setting unit 50 toward the printing unit 25. The second medium setting unit 50 is disposed above the first medium setting unit 16 and is disposed so that the printing unit 25 is interposed between the second medium setting unit 50 and the first medium setting unit 16.

The second medium setting unit 50 includes a medium placement surface 51 on the upper surface of the lid 14 that forms the upper surface of the apparatus main body 12. The medium placement surface 51 is constituted by a portion interposed between horizontal surfaces formed at both end portions in the width direction in the upper surface of the lid 14. The medium placement surface 51 is composed of a first placement surface 41*a* provided on the upper surface of the first lid 41 and a second placement surface 43 provided on the upper surface of the second lid 42. The first placement surface 41*a* tilts so as to descend rearward.

The second placement surface 43 has, on the front side, an upstream-side horizontal surface 43*a* and, on the rear side, a downstream-side inclined surface 43*b* inclined so as to descend toward the rear side.

The upstream-side horizontal surface 43*a* and the downstream-side inclined surface 43*b* are continuous in the depth direction. The downstream-side inclined surface 43*b* of the second placement surface 43 and the first placement surface 41*a* are connected to each other in the depth direction. Therefore, the medium placement surface 51 is formed by connecting the upstream-side horizontal surface 43*a*, the downstream-side inclined surface 43*b*, and the first placement surface 41*a* from the front side to the rear side.

An inclined surface 45 that is continuous and inclined so as to descend rearwards is constituted by the downstream-side inclined surface 43*b* and the first placement surface 41*a* of the second placement surface 43. The medium placement surface 51 is composed of the upstream-side horizontal surface 43*a* and the inclined surface 45, and the inclined surface 45 is positioned lower than the upstream-side horizontal surface 43*a* in the height direction. Therefore, the inclined surface 45 is provided so as to be recessed from the upstream-side horizontal surface 43*a*. Due to the inclined surface 45, a recessed portion recessed from the upstream-side horizontal surface 43*a* is provided on the upper surface of the apparatus main body 12.

If the medium S is a postcard, the entire medium S is placed on the inclined surface 45 and housed in the recessed portion. When the medium S is an A4 sheet, a portion of the medium S is placed on the inclined surface 45 and is housed in the recessed portion and a portion of the medium S is placed on the upstream-side horizontal surface 43*a*. A pair of edge guides 44 slidable in the width direction are provided on the first placement surface 41*a*. The medium S placed on the first placement surface 41*a* is positioned in the width direction by being interposed between the pair of edge guides 44.

Figure 4:
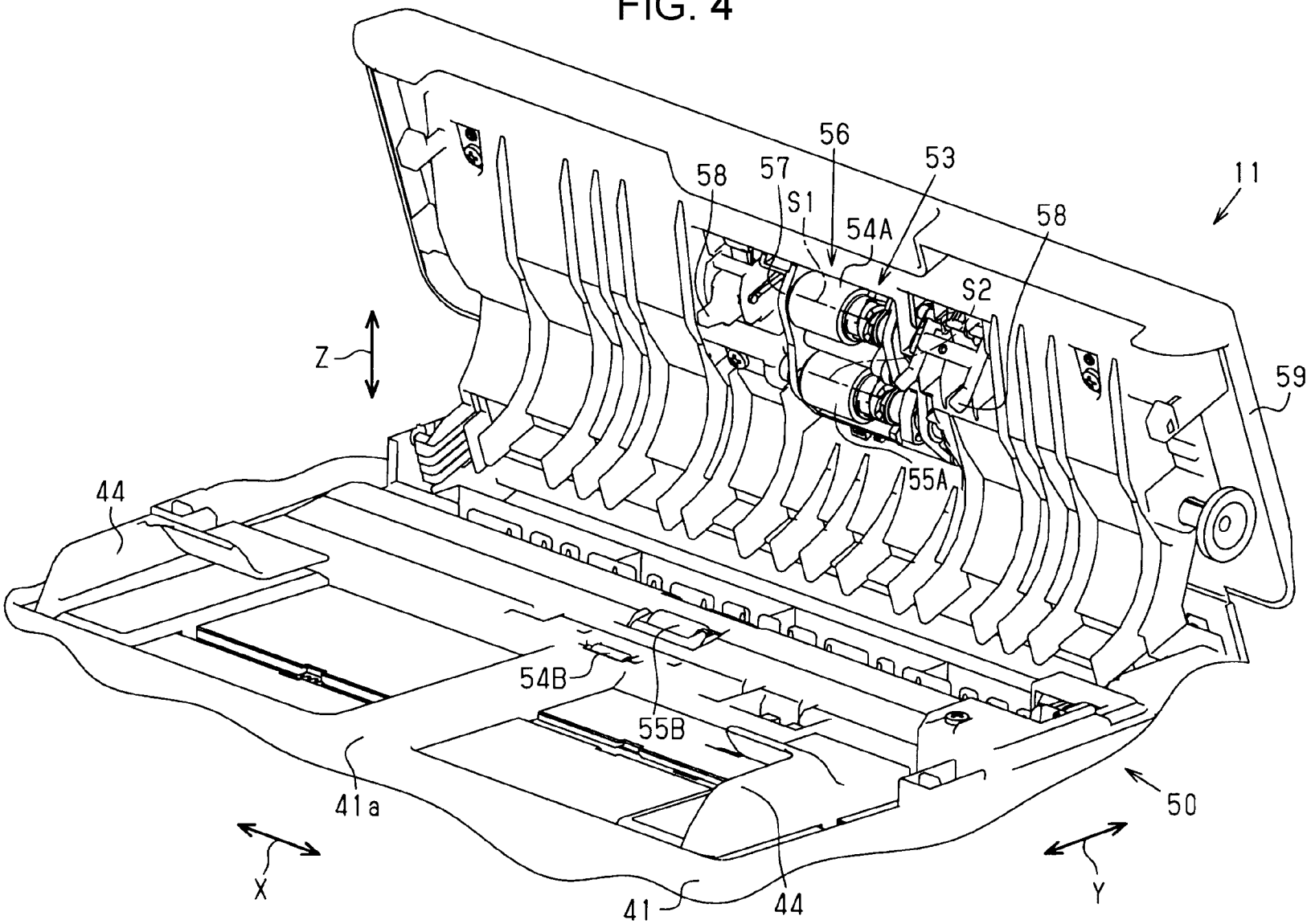
FIG. 4 is a perspective view illustrating the printing apparatus in which an inverting cover is in an open state.

As illustrated in FIG. 2 and FIG. 4, the second medium setting unit 50 includes an inverting cover 59 supported by the first lid 41. The inverting cover 59 is rotatably attached to the first lid 41. The inverting cover 59 is provided so as to be displaceable between an open position where the first placement surface 41*a* of the medium placement surface 51 is exposed and a closed position where the inverting cover 59 covers the first placement surface 41*a* from the upper side.

When the inverting cover 59 is in the closed position, on the upper surface of the apparatus main body 12, between the first placement surface 41*a* having a downward slope toward the rear side and the front edge of the inverting cover 59, which is horizontal, a paper feed port 60 for allowing the medium S to be fed into the apparatus main body 12 by manual insertion by a user is formed so that its opening faces the front side. With respect to the positional relationship with the paper feed port 60, the medium placement surface 51 is provided so as to extend along the paper feed direction from a position more on the front surface side than the paper feed port 60 toward the paper feed port 60. Further, note that the paper feed port 60 may feed the medium S sheet by sheet by manual insertion by a user or may feed a plurality of sheets of media S collectively.

When viewed from the paper feed direction, the first lid 41 of the lid 14 is disposed on the downstream side in the paper feed direction, and the second lid 42 is disposed on the upstream side in the paper feed direction. In addition, the first placement surface 41*a* of the medium placement surface 51 is inclined so as to descend from the upstream side to the downstream side in the paper feed direction, the upstream-side horizontal surface 43*a* of the second placement surface 43 is located on the upstream side in the paper feed direction, and the downstream-side inclined surface 43*b* is inclined so as to descend from the upstream side to the downstream side in the paper feed direction on the downstream side of the upstream-side horizontal surface 43*a* in the paper feed direction.

The inclined surface 45 of the medium placement surface 51 is formed such that the downstream-side inclined surface 43*b* of the second placement surface 43 and the first placement surface 41*a* are continuous in the paper feed direction and is inclined so as to descend from the upstream side to the downstream side in the paper feed direction.

The medium S fed by the user manually from the paper feed port 60 is fed to the printing unit 25 side through the second transport path 52 provided in the apparatus main body 12. The end portion of the second transport path 52 on the side opposite to the end portion on the side of the paper feed port 60 is joined to the first transport path 27 on the peripheral surface of the feed roller 35. In addition, the second transport path 52, in the middle portion thereof in the length direction, extends downward from a position on the rear side of the paper feed port 60 and has a curved portion 52*a* that is curved toward the front diagonally downward where the junction point of the first transport path 27 is located. When the medium S passes through the curved portion 52*a* in the second transport path 52, its front and rear surfaces become inverted.

As illustrated in FIG. 2, on the second transport path 52, closer to the side where the paper feed port 60 is located than to the curved portion 52*a*, a second feeding unit 53 including a pair of separation rollers 54 and a pair of feeding rollers 55, which will be described later, is provided. The second feeding unit 53 feeds the medium S toward the printing unit 25 via the second transport path 52 by the pair of separation rollers 54 and the pair of feeding rollers 55, which correspond to a pair of feeding rollers, rotating while nipping the medium S, which has been fed from the paper feed port 60, from the front and rear sides. In this respect, the second transport path 52 is capable of guiding the medium S fed from the paper feed port 60 toward the printing unit 25 in the apparatus main body 12, and functions as a feed path having, in its middle portion, the curved portion 52*a* for inverting the medium S during guidance.

The second feeding unit 53 includes the pair of separation rollers 54 and the pair of feeding rollers 55 disposed at a position on the rear side of the pair of separation rollers 54. The pair of separation rollers 54 is formed of a driving roller 54A provided on the inverting cover 59 and a separation roller 54B (retard roller) provided on the upper surface of the first lid 41. The separation roller 54B rotates at a slightly lower rotational speed than the driving roller 54A, with the friction coefficient of the outer peripheral surface of the separation roller 54B with respect to the medium S being larger than that of the driving roller 54A. Even if a plurality of sheets of the media S overlap and are fed, by using the difference in friction coefficient and the rotational speed difference between the outer peripheral surfaces of both the driving roller 54A and the separation roller 54B, the pair of separation rollers 54 separate the lowermost sheet and feed it to the downstream side in the paper feed direction.

The pair of feeding rollers 55 are formed of a driving roller 55A provided on the inverting cover 59 and a driven roller 55B provided on the first lid 41. As illustrated in FIG. 2, the pair of feeding rollers 55 are provided so that the nipping point at which the medium S is nipped by the driving roller 55A and the driven roller 55B is located on the extension line L of the inclined surface 45 of the medium placement surface 51. The pair of feeding rollers 55 are rotationally driven so as to transport the medium S at the same transport speed as that of the pair of separation rollers 54. The separation roller 54B and the driven roller 55B rotate together with the rotation of the pair of driving rollers 54A and 55A.

As illustrated in FIG. 4, the driving rollers 54A and 55A are swingably supported by the inverting cover 59 as a delivery roller unit 56. The delivery roller unit 56 is provided with a frame body 57 having a generally rectangular shape in plan view. Inside the frame body 57, the driving rollers 54A and 55A are supported so as to be rotatable around axes S1 and S2 extending in the width direction of the apparatus main body 12 in a state where the driving rollers 54A and 55A are juxtaposed parallel to each other. As illustrated in FIG. 2, in the frame body 57, the driving roller 55A and the driven roller 55B of the pair of feeding rollers 55 are always arranged on the swing fulcrum side of the frame body 57 so that the driving roller 55A and the driven roller 55B always come into contact with each other, and the driving roller 54A of the pair of separation rollers 54 is disposed on the front side of the driving roller 55A.

The delivery roller unit 56 is configured to be displaceable between a delivery position where the driving roller 54A of the pair of separation rollers 54 is in contact with the separation roller 54B and a non-delivery position where it is separated upward from the separation roller 54B.

The second feeding unit 53 includes stoppers 58 disposed at positions interposing the pair of separation rollers 54 in the width direction. The stoppers 58 are arranged at positions that the medium S inserted toward the pair of separation rollers 54 comes into contact with when the delivery roller unit 56 is in the non-delivery position. In addition, the stoppers 58 are adapted to retract toward the inverting cover 59 when the delivery roller unit 56 is in the delivery position. The lower portion of the delivery roller unit 56 enters a recessed portion formed by provision of the inclined surface 45.

Next, the operation of the printing apparatus 11 of the present embodiment configured as described above will be described. Further, as a prerequisite for the explanation, in a stage before the operation unit 19 is operated, the delivery roller unit 56 is in the delivery position where the driving roller 54A is in contact with the separation roller 54B and it is assumed that the stoppers 58 are in a position retracted toward the inverting cover 59.

In the case where printing is performed by the printing unit 25 on the medium S fed by manual insertion into the second medium setting unit 50, the medium S is inserted from the paper feed port 60 until it comes into contact with the nip point of the pair of separation rollers 54 and the medium S is made to reach the second feeding unit 53. At this time, because the end of the medium S abuts against the pair of separation rollers 54 and is not yet curved at this point and is in a flat state along the medium placement surface 51, bending, which is likely to occur when the medium S abuts against the pair of separation rollers 54 in a curved state, is suppressed. When the operation unit 19 is operated to start printing, the pair of separation rollers 54 are driven to feed the medium S toward the pair of feeding rollers 55 positioned on the downstream side in the paper feed direction. At this time as well, because the end of the medium S abuts against the pair of feeding rollers 55 and is not yet curved at this point and is in a flat state along the medium placement surface 51, bending, which is likely to occur when the medium S abuts against the pair of feeding rollers 55 in a curved state, is suppressed. The pair of feeding rollers 55 rotate so as to transport the medium S at the same transport speed as that of the pair of separation rollers 54 and feed the medium S to the downstream side in the paper feed direction.

The medium S fed by the second feeding unit 53 is inverted via the curved portion 52*a* of the second transport path 52 and then transported toward the junction point of the first transport path 27 located on the peripheral surface of the feed roller 35. The feed roller 35 transports the medium S while curving the medium S from the upper side to the front side along the first transport path 27. The transport roller 36 transports the medium S transported by the feed roller 35 forward along the first transport path 27. The medium S transported onto the medium supporting unit 26 is printed on by the printing unit 25. The medium S on which printing has been completed is discharged from the discharge port 17 onto the discharge tray 18.

According to the embodiment described above, the following effects can be obtained.

(1) The end portion of the medium S, which is fed from the paper feed port 60 into the apparatus main body 12 and guided toward the printing unit 25 via the second transport path 52, abuts against the pair of separation rollers 54 before reaching the curved portion 52*a* in the second transport path 52. Then, from this state, the pair of separation rollers 54 rotate while nipping the medium S from the front and rear sides so that the fed medium S is fed to the printing unit 25 along the curved portion 52*a*. That is, even though the fed medium S curves when it passes through the curved portion 52*a* of the second transport path 52, the medium S abuts against the pair of separation rollers 54 before bending and does not become curved. Therefore, it is possible to inhibit bending when the fed medium S is fed through the curved path toward the printing unit 25 in the apparatus main body 12.

(2) The paper feed port 60 opens toward the front side of the apparatus main body 12, and on the upper surface of the apparatus main body 12, the medium placement surface 51 on which the medium S can be placed is provided so as to be located closer to the front side than the paper feed port 60 and so as to extend along the paper feed direction toward the paper feed port 60. As a result, the user can place the medium S for paper feeding from the front side of the apparatus main body 12 on the medium placement surface 51 provided on the upper surface of the apparatus main body 12, and the medium S can be easily fed from the paper feed port 60 into the second transport path 52 by sliding it rearward from the front side along the medium placement surface 51.

(3) The medium placement surface 51 is provided on the upper surface of the lid 14, and the lid 14 includes the first lid 41 disposed on the downstream side in the paper feed direction and the second lid 42 disposed on the upstream side in the paper feed direction. The first lid 41 is fixed to the housing 13 and the second lid 42 is attached to the housing 13 so as to be displaceable between an open position in which the opening portion 13*a* is open and a closed position in which the opening portion 13*a* is closed. As a result, even if the medium placement surface 51 is provided on the upper surface of the lid 14, the interior of the housing 13 can be viewed by displacing the second lid 42 of the lid 14 to the open position.

4) The medium placement surface 51 has the inclined surface 45 which is inclined so as to descend from the upstream side to the downstream side in the paper feed direction. As a result, by utilizing the inclination of the inclined surface 45 of the medium placement surface 51, the medium S placed on the medium placement surface 51 is easily fed to the paper feed port 60. In addition, on the upper surface of the apparatus main body 12, the height of the portion provided with the inclined surface 45 can be lower than the height of the portion without the inclined surface 45.

(5) The medium placement surface 51 has the first placement surface 41*a* disposed on the upper surface of the first lid 41 and the second placement surface 43 disposed on the upper surface of the second lid 42, and the first placement surface 41*a* is inclined so as to descend from the upstream side to the downstream side in the paper feed direction. The second placement surface 43 includes the upstream-side horizontal surface 43*a* positioned on the upstream side in the paper feed direction and a downstream-side inclined surface 43*b* that is inclined so as to descend from the upstream side to the downstream side in the paper feed direction on the downstream side of the upstream-side horizontal surface 43*a* in the paper feed direction, and the inclined surface 45 is formed in which the downstream-side inclined surface 43*b* and the first placement surface 41*a* are continuous in the paper feed direction. As a result, for example, compared with the case where an inclined surface is provided only in the first lid 41, the area of the inclined surface 45 in the medium placement surface 51 is increased. Therefore, it becomes easier to feed the medium S placed on the medium placement surface 51 toward the paper feed port 60.

(6) On the first placement surface 41*a*, the edge guides 44 that enable positioning of the medium S placed on the medium placement surface 51 in the width direction are provided. As a result, it is possible to suppress skewing with respect to the paper feed direction from occurring on the medium S placed on the medium placement surface 51 by the edge guides 44.

Further, it should be noted that the above embodiment may be modified as follows. In addition, a modification example may be adopted by appropriately combining the following modification examples that can be combined.

The edge guides 44 of the medium placement surface 51 may be omitted.

The edge guides 44 may be provided on the downstream-side inclined surface 43*b* of the second lid 42 or may be provided on the upstream-side horizontal surface 43*a*.

The upstream-side horizontal surface 43*a* of the second lid 42 may be omitted, the entire upper surface of the second lid 42 may be inclined, and the inclined surface 45 may be constituted by the entire upper surface of the second lid 42 and the first placement surface 41*a* of the first lid 41.

The entire upper surface of the second lid 42 may be a horizontal surface and the inclined surface 45 may be composed of only the first placement surface 41*a* of the first lid 41.

The inclined surface 45 need not be provided on the upper surface of the lid 14 and the medium placement surface 51 may be a horizontal surface.

In the lid 14, the first lid 41 may be attached to the housing 13 so as to be rotatable, the opening portion 13*a* of the housing 13 can be covered with the first lid 41, and the second lid 42 may be fixed to the housing 13.

The driving roller 54A of the pair of separation rollers 54 and the driving roller 55A of the pair of feeding rollers 55, which make up a portion of the second feeding unit 53, are arranged in the inverting cover 59; however, the entirety of the second feeding unit 53 may be disposed in the lid 14 (the first lid 41) or in the inverting cover 59.

The pair of feeding rollers may be formed of only the pair of feeding rollers 55 and the pair of separation rollers 54 may be omitted.

The medium S is not limited to a paper sheet and may be a plastic film or the like.

The printing apparatus is not limited to a printing apparatus that prints images or the like on a medium such as paper sheet or film and may be an industrial printing apparatus used for manufacturing electronic parts or the like using printing technology (inkjet technology). As an industrial printing apparatus of this type there is, for example, a printing apparatus that forms electrodes, pixels and the like by recording through ejection of a material liquid onto a substrate (an example of a medium) such as a liquid crystal display, an electroluminescence (EL) display, a surface emitting display or the like. Further, the printing apparatus may be a three-dimensional inkjet printer that manufactures a three-dimensional model by discharging a liquid such as a resin liquid.

The entire disclosure of Japanese Patent Application No. 2017-248843, filed Dec. 26, 2017 is expressly incorporated by reference herein.

What is claimed is:

1. A printing apparatus comprising:

a printing unit that performs printing on a medium by using a liquid;

an apparatus main body that houses the printing unit therein and that has outer surfaces including an upper surface and a front surface that adjoiningly intersects the upper surface;

a paper feed port that is provided on the upper surface of the apparatus main body and that enables the medium to be fed into the apparatus main body;

a feed path that is guiding the medium fed from the paper feed port toward the printing unit in the apparatus main body and that has a curved portion for inverting the medium during the guiding; and a pair of rollers that are provided at the upstream of the curved portion in the feed path and that feed the medium toward the printing unit via the feed path by rotating while nipping the medium fed from the paper feed port from both front and rear sides.

2. The printing apparatus according to claim 1, wherein the paper feed port opens toward a front side of the apparatus main body and a medium placement surface on which the medium can be placed is provided on the upper surface of the apparatus main body so as to extend along a paper feed direction from the front side toward the paper feed port.

3. The printing apparatus according to claim 2, wherein the apparatus main body includes a housing having an opening portion on an upper surface of the housing and a lid attached to the housing so as to close the opening portion, wherein the medium placement surface is provided on an upper surface of the lid, and wherein the lid includes a first lid disposed on a downstream side in the paper feed direction and a second lid disposed on an upstream side in the paper feed direction, one of the first lid and the second lid is fixed to the housing, and the other is attached to the housing so as to be displaceable between an open position in which the opening portion is open and a closed position in which the opening portion is closed.

4. The printing apparatus according to claim 3, wherein the medium placement surface has an inclined surface that is inclined so as to descend from the upstream side to the downstream side in the paper feed direction.

5. The printing apparatus according to claim 4, wherein the medium placement surface has a first placement surface disposed on an upper surface of the first lid and a second placement surface disposed on an upper surface of the second lid, wherein the first placement surface is inclined so as to descend from the upstream side to the downstream side in the paper feed direction, wherein the second placement surface includes an upstream-side horizontal surface positioned on the upstream side in the paper feed direction and a downstream-side inclined surface that is inclined so as to descend from the upstream side to the downstream side in the paper feed direction on the downstream side of the upstream-side horizontal surface in the paper feed direction, and wherein the inclined surface is formed so that the downstream-side inclined surface of the second placement surface and the first placement surface are continuous in the paper feed direction.

6. The printing apparatus according to claim 5, wherein edge guides that enable positioning of the medium placed on the medium placement surface in a width direction are provided on the first placement surface.

* * * * *